United States Patent [19]

Hattori et al.

[11] 4,395,654

[45] Jul. 26, 1983

[54] FLUORESCENT DISPLAY APPARATUS

[75] Inventors: Takashi Hattori; Satoru Makita, both of Mobara, Japan

[73] Assignee: Futaba Denshi Kogyo Kabushiki Kaisha, Chiba, Japan

[21] Appl. No.: 190,218

[22] Filed: Sep. 24, 1980

[30] Foreign Application Priority Data

Oct. 4, 1979 [JP] Japan ..... 54-137534[U]

[51] Int. Cl.[3] ..... H01J 63/06; H01J 63/02

[52] U.S. Cl. ..... 313/496; 313/513

[58] Field of Search ..... 313/496, 497, 510, 513, 313/517, 500

[56] References Cited

U.S. PATENT DOCUMENTS 3,800,178 3/1974 Farina ..... 313/497

3,892,471 7/1975 Biermann et al. ..... 313/517 X 3,938,140 2/1976 Garcia et al. ..... 313/513 X 4,012,243 3/1977 Keil et al. ..... 313/500 X 4,086,514 4/1978 Havel ..... 313/500 X

*Primary Examiner*—Palmer C. Demeo

*Attorney, Agent, or Firm*—Oblon, Fisher, Spivak, McClelland & Maier

[57] ABSTRACT

There is disclosed a display pattern for fluorescent display apparatus which effects displays of several sorts of informations in different colors or different luminance brightness. The display pattern is composed of seven segmented anodes each of which is divided into a plurality sub-segments which are classified into at least two groups electrically connected in common and extended to external terminals so that the different informations may be displayed in the respective groups of the segments.

4 Claims, 9 Drawing Figures

FIG. 1
PRIOR ART
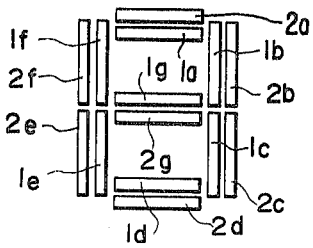
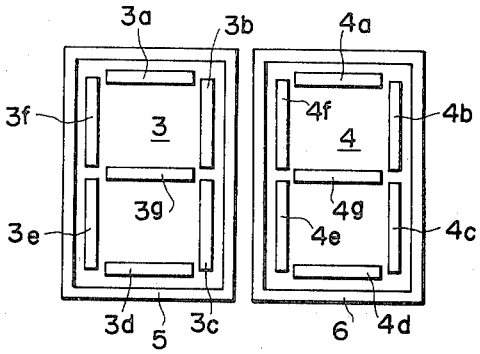
FIG. 2
PRIOR ART
FIG. 3
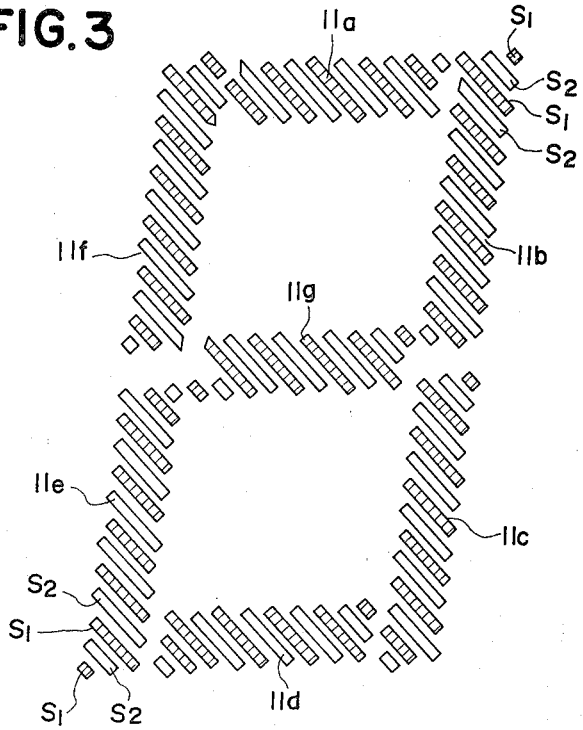

FLUORESCENT DISPLAY APPARATUS

BACKGROUND OF THE INVENTION

1. Field of the Invention

This invention relates to a fluorescent display apparatus, and more particularly to a segment type fluorescent display apparatus which effects displays of numerals, letters and the like by a combination of bar-shaped segmented anodes.

2. Description of the Prior Arts

A fluorescent display apparatus is widely used as a display device in various electronic or electrical instruments, because it is a self-illuminating display device which can be driven at a relatively low voltage and is low in power consumption and excellent in luminous color. Phosphors which are the most commonly used in the conventional fluorescent display devices are ZnO:Zn system phosphors which emit green. Recently, a fluorescent display apparatus which can emit luminous colors of other than green is required in the various fields industry. In order to meet such a demand, phosphors for use in the fluorescent display apparatus other than ZnO:Zn phosphor have been developed and come into actual use, such as, for example, red emitting phosphors which are based upon a mixed conductive material with $Y_2O_3$:Eu, $Y_2O_2S$:Eu or $YVO_4$:Eu phosphor, a yellow emitting phosphor which is based upon a mixed conductive material with a ZnS:Mn phosphor or a blue emitting phosphor which is based upon a mixed conductive material with a ZnS:Ag phosphor.

In the prior art, there are several proposals for producing a numeral or character display apparatus which changes its display color responding to input signals within a single display apparatus by using the newly developed as well as the conventional ZnO:Zn phosphors.

FIG. 1 shows a display pattern of the conventional numeral or character display apparatus. The display pattern is composed of seven segmented anodes 1*a* to 1*g* (hereinafter referred to as a segment) which are arranged in the form of the figure "8" to form an inner display portion, and additional seven segments 2*a* to 2*g* arranged in close proximity to each of the segments 2*a* to 2*g* of the inner display portion to form an outer display portion. The inner and the outer display portions have deposited thereon phosphors of different luminous colors, respectively, thereby to form one display portion. In the display pattern shown in FIG. 1, spaces for connecting the segments 2*a* and 2*b* and the segments 2*c* and 2*d* are too wide, and the connecting portions of the segments 2*g*, 2*b* and 2*c* or the segments 2*g*, 2*f*, 2*e* are too unnatural. The digits displayed by the display pattern shown in FIG. 1 are less appealing and hardly legible. Therefore, it is not put to practical use.

As another approach, there is proposed a display pattern improving legibility of the display numerals and effecting the display in multicolors as shown in FIG. 2. In the display pattern shown in FIG. 2, one digit of the numeral display portion is composed of a pair of seven segments 3*a* to 3*g* and 4*a* to 4*g*, which are connected in common at each of the corresponding segments 3*a* and 4*a*, 3*b* and 4*b*, . . . , and 3*g* and 4*g*, thereby to form display portions 3 and 4. The segments 3*a* to 3*g* and 4*a* to 4*g* of the respective display portions 3 and 4 have deposited thereon phosphors of different luminous colors, and either of the display portions is energized and illuminated by selecting either a grid 5 or 6 depending upon an input signal. In the display pattern shown in FIG. 2, it is hard to make reading of the displayed numerals, because the numerals in the respective colors are displayed in different locations. This deteriorates space factor in the display apparatus. Furthermore, in a multi-digit display apparatus, the displays are hard to scan, because the display patterns are illuminated with wide spaces therebetween.

In the conventional fluorescent display apparatus of another type, a mixed phosphor made of two phosphors each having different luminous color is deposited on segments, and the phosphors are illuminated in the respective colors by changing anode voltage. This fluorescent display apparatus effects the luminous display by making use of the characteristics of the phosphors each having different threshold luminous voltage and driving voltage for effecting the illumination of sufficient brightness, however, the luminous color in this fluorescent display apparatus is unsatisfactory, because it is not pure.

SUMMARY OF THE INVENTION

In view of the above, it is an object of the present invention to provide a fluorescent display apparatus for effecting displays of several sorts of informations in the same display portion having time lag.

It is another object of the present invention to provide a fluorescent display apparatus which is capable of switching luminance brightness or display color depending upon contents of informations to be displayed.

According to the present invention, the foregoing and other objects are attained by providing a fluorescent display apparatus which comprises segmented anodes, each of which is divided into a plurality of sub-segments which are in turn classified into two groups electrically connected in common and extended to outer terminals.

BRIEF DESCRIPTION OF THE DRAWINGS

Other objects and many of the attendant advantages of this invention will be readily appreciated as the same becomes better understood by reference to the following detailed description when considered in connection with the accompanying drawings, in which like reference characters designate the same or similar parts throughout the figure thereof and wherein:

FIG. 1 is a schematic illustration of a display pattern used in a conventional fluorescent display apparatus;

FIG. 2 is a schematic illustration of another display pattern used in a conventional fluorescent display apparatus;

FIG. 3 is a plan view of a display pattern for fluorescent display apparatus constructed in accordance with a first embodiment of the present invention;

DETAILED DESCRIPTION OF THE PREFERRED EMBODIMENTS

A fluorescent display apparatus according to an embodiment of the present invention will now be described in connection with the drawings.

FIG. 3 is a plan view schematically illustrating a display pattern used in a fluorescent display apparatus according to an embodiment of the present invention. The display pattern shown in FIG. 3 is primarily to identify decimal digits and has seven numeric segments 11*a* to 11*g* arranged so as to delineate the digit "8". Each of the segments 11*a* to 11*g* is divided into a plurality of subsegments S ($S_1$, $S_2$). The sub-segments $S_1$ identified as marking oblique parallel lines in FIG. 3 and the unhatched sub-segments $S_2$ have deposited thereon phosphors of different luminous colors to be excited by impingement of electrons emitted from a cathode (not shown), respectively. For example, the sub-segment $S_1$ have deposited thereon phosphor layers made of a ZnO:Zn phosphor which emit green light upon impingement of thermions, while the sub-segment $S_2$ have deposited thereon phosphor layers made of a $Y_2O_2S$:Eu combined with electrical conductive materials which emit red light upon impingement of thermions.

In general, a fluorescent display apparatus comprises a base plate of an insulator, glass or ceramics, for example. Wiring conductors are applied to the surfaces of the base plate for supplying electrical signals to the segments 11*a* to 11*g* of other electrodes (not shown), and covered with an insulating film for electrically insulating intervals of the respective wiring conductors and for electrically insulating the segments 11*a* to 11*g* and the wiring conductors. At the predetermined positions of the insulating film, there is provided through-holes each communicating with corresponding the wiring conductors and the segments 11*a* to 11*g* to be electrically connected by conductive material filled in the through-holes. Each of the processes for producing the fluorescent display apparatus described hereinabove is conducted by thin or thick film technology.

Figure 4:
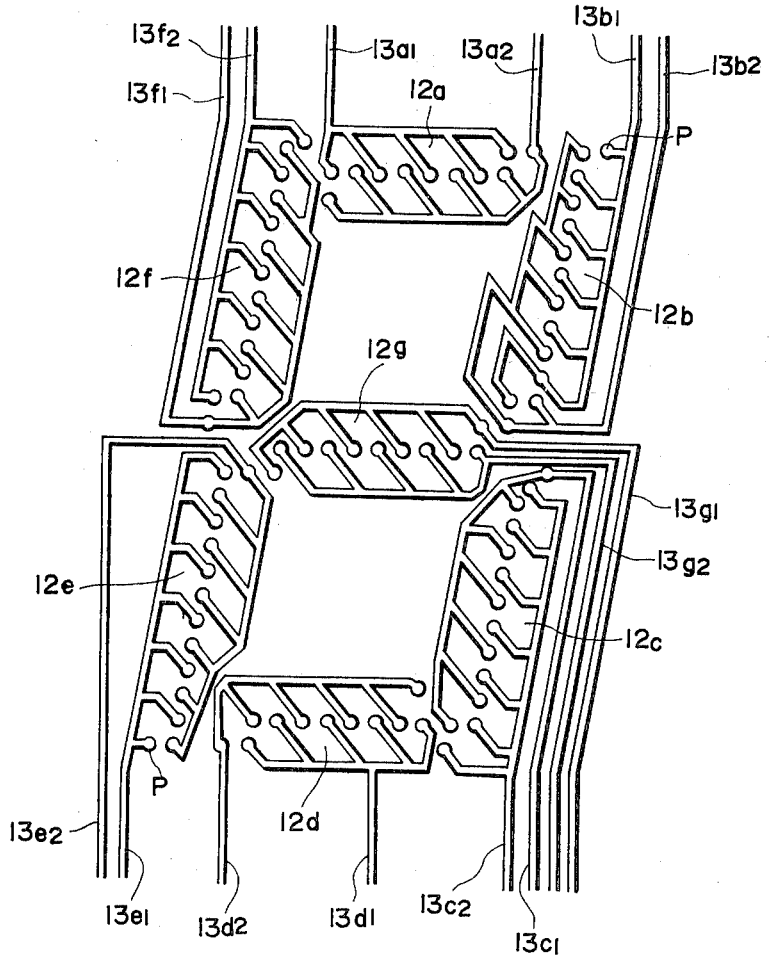
FIG. 4 shows a pattern of wiring conductors for electrically connecting the display pattern shown in FIG. 3.

FIG. 4 shows a pattern of wiring conductors to be electrically connected to the display pattern shown in FIG. 3. The wiring conductors are formed on the surface on the base plate in such a pattern as shown in FIG. 4 by a screen printing using conductive materials which are processed in a paste form.

The wiring pattern includes a wiring pattern 12*a* corresponding to the segment 11*a* and a wiring pattern 12*b* corresponding to the segment 11*b*. In the same manner, a wiring pattern 12*g* is formed so as to correspond to the segment 11*g*. Each of the wiring patterns 12*a* to 12*g* is provided with pads P electrically divided into two lines and each connected in common so as to be connected to each of the sub-segments $S_1$ and $S_2$ of the respective segments 11*a* to 11*g* by means of the through-holes. As shown in FIG. 4, each two lines of the respective wiring patterns 12*a* to 12*g* is of comblike configuration and is interdigitated in opposed relationship at the pectinated tips thereof. The wiring patterns 12*a* to 12*g* include leads 13 (13$a_1$, 13$a_2$, 13$b_1$, 13$b_2$ . . . 13$g_1$ and 13$g_2$) at the respective lines thereof which are to be connected to outer terminals (not shown). By the provision of the wiring patterns 12*a* to 12*g*, each of the sub-segments $S_1$ and $S_2$ in the respective segments 11*a* to 11*g* is connected in common, and each of the segments 11*a* to 11*g* is led out by two leads 13. In this manner, the fluorescent display apparatus is formed by arranging the required number of the display patterns on the base plate, mounting a cathode, if necessary, control electrodes above the display patterns, and airtightly extending the outer terminals connected to the leads 13 out of a vacuum casing which contains the display patterns and the electrodes.

According to the display pattern explained hereinabove, when displaying the decimal digit "1" by the segments 11*b* and 11*c*, anode voltage is applied to the sub-segments $S_1$ in the segments 11*b* and 11*c* which are shown by applying the oblique lines in FIG. 3 through the leads 13$b_1$ and 13$c_1$. Then, the phosphor layers, for instance, a ZnO:Zn phosphor, deposited on the sub-segments $S_1$ is excited by the electrons, thereby to display the decimal digit "1" in green luminous color. When applying the anode voltage to the leads 13$b_2$ and 13$c_2$, the electrons are impinged upon the sub-segments $S_2$ in the segments 11*b* and 11*c* which are shown without applying the oblique lines in FIG. 3 and is deposited, for example, a red emitting phosphor thereon, thereby to display the decimal digit "1" in red luminous color at the almost same location in the segments in which the digit "1" is displayed in green. In this manner, each of the numeric segments has been given a different arbitrary number and the decimal digits "0" to "9" are displayed in multicolor.

In the display pattern according to the present invention, the same decimal digit is display in different colors in the almost same location in the segments. Thus, the display is extremely easy to observe and space factor in the display apparatus is significantly improved. In addition, connecting portions of each of the segments 11*a* to 11*g* can be adjacent at the almost the same intervals as those of the conventional monochromatic fluorescent display apparatus. Accordingly, the digit shape to be displayed is not unduly distorted, and legible and high grade of the display can be represented. Furthermore, each of the segments 11*a* to 11*g* is divided into a plurality of the sub-segments S which are to be selectively energized and illuminated to identify any one of the decimal digits. Thus, the decimal digit displayed by the segments 11*a* to 11*g* can be observed in a continuous fashion by a combination of the sub-segments being energized, which make it possible to represent the display in natural manner. In the embodiment explained hereinabove, the display pattern is shown as including seven segments, each of which is divided into a plurality of the rectangular subsegments S. However, it should be understood that the sub-segment is not limited to the rectangular shape, but the segments 11*a* to 11*g* may be divided in various shape, such as, for example, dot or square shape as shown in FIG. 5.

Figure 5:
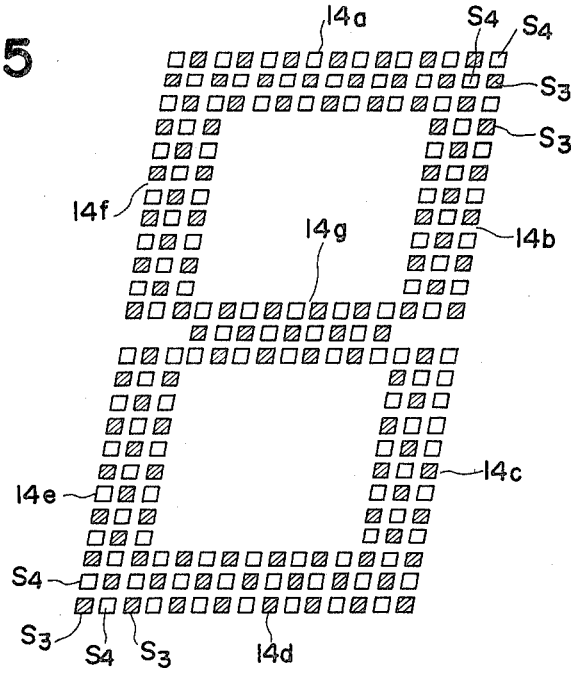
FIG. 5 is a plan view of a display pattern for fluorescent display apparatus constructed in accordance with a second embodiment of the present invention.

A display pattern shown in FIG. 5 consists of segments 14*a* to 14*g*, each of which is composed of sub-segments $S_3$ and $S_4$. The sub-segments $S_3$ are shown with a hatching and the sub-segments $S_4$ are shown without the hatching in FIG. 5. Each of the sub-segments $S_3$ and $S_4$ in the respective segments 14*a* and 14*g* is connected in common by wiring conductors, and phosphors of different luminous colors are deposited on the sub-segments $S_3$ and $S_4$, respectively, so that the display color may be changed in the same manner as the preceeding embodiment. In the embodiment shown in FIG. 5, each of the segments 14*a* to 14*g* is sub-divided, and has deposited thereon the phosphors of different luminous colors alternately so that the segment S may be a checkered pattern. In the display pattern shown in FIG. 5, the sub-segments deposited the phosphor of the same color are arranged in diagonally opposited relationship in each of the segments 14*a* to 14*g*. Thus, the wiring pattern for connecting the sub-segments $S_3$ and $S_4$ in each of the segments 14*a* to 14*g* may be formed substantially in the same shape as that of the wiring pattern shown in FIG. 4. In this embodiment, the comblike wiring patterns are interdigitated in opposed relationship at the pectinated tips thereof so that the tip portions of the respective comblike wiring patterns are deeply encroached one another, and the tip portions of the comblike patterns are provided with a plurality of pads P.

Figure 6:
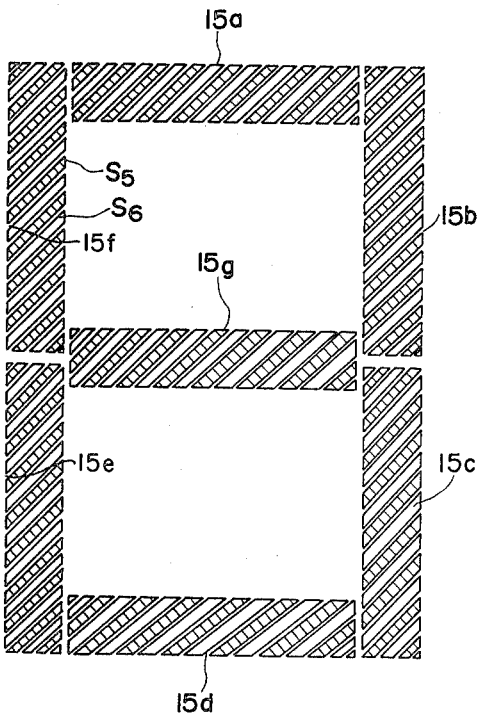
FIG. 6 is a plan view of a display pattern for fluorescent display apparatus constructed in accordance with a third embodiment of the present invention.
Figure 7:
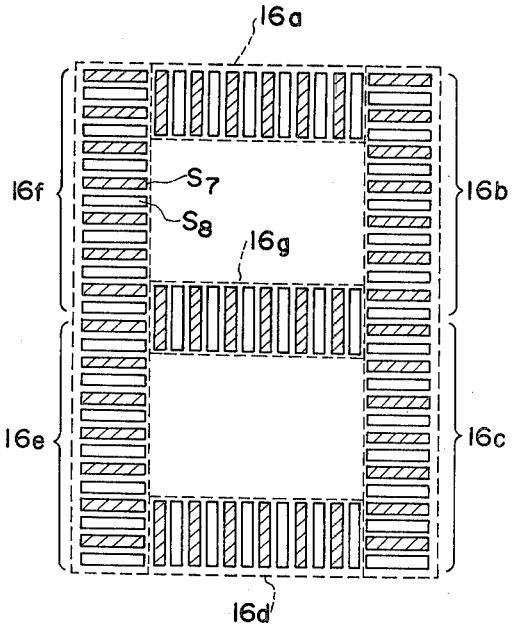
FIG. 7 is a plan view of a display pattern for fluorescent display apparatus constructed in accordance with a fourth embodiment of the present invention.

The segments may be divided in such a manner as shown in FIGS. 6 and 7. A display pattern shown in FIG. 6 consists of segments 15*a* to 15*g*, each of which is divided into sub-segments $S_5$ and $S_6$ arranged in a slanted fashion. The sub-segments $S_5$ identified as marking a hatching and the unhatched sub-segment $S_6$ in FIG. 6 have deposited thereon phosphor of different luminous colors, respectively. A display pattern shown in FIG. 7 consists of segments 16*a* to 16*g*, each of which is divided into rectangular sub-segments $S_7$ and $S_8$ arranged in horizontal and vertical fashion. The sub-segments $S_7$ identified as marking a hatching and the unhatched sub-segment $S_8$ in FIG. 7 have deposited thereon phosphors of different luminous colors, respectively.

It is to be understood that the shape of the display pattern is not limited to the shape of FIG. "8", shown in FIGS. 3, 5, 6 and 7, but it may be in the form of a plus sign in square or a combination of plus and X signs in square so that alphabetical numerals may be represented in different colors. The fluorescent display apparatus according to the present invention can be used in various ways. For example, the display patterns shown in FIGS. 3 and 5 may be illuminated in a third color mixing the luminous colors of the respective phosphors deposited on the sub-segments $S_1$ and $S_2$ or $S_3$ and $S_4$ by applying the anode voltage simultaneously to both the sub-segments. In the embodiment explained hereinabove, the sub-segments $S_1$ and $S_2$ have deposited thereon the phosphors of the different luminous colors, however, a phosphor emitting single color may be deposited on the sub-segments $S_1$ and $S_2$. In this instance, the display pattern can be illuminated in the single color of different luminous intensities either by applying the anode voltage simultaneously to both the sub-segments $S_1$ and $S_2$ or one of the sub-segments $S_1$ and $S_2$.

Reference will now be made to a driving circuit for fluorescent display apparatus shown in FIGS. 8 and 9.

Figure 8:
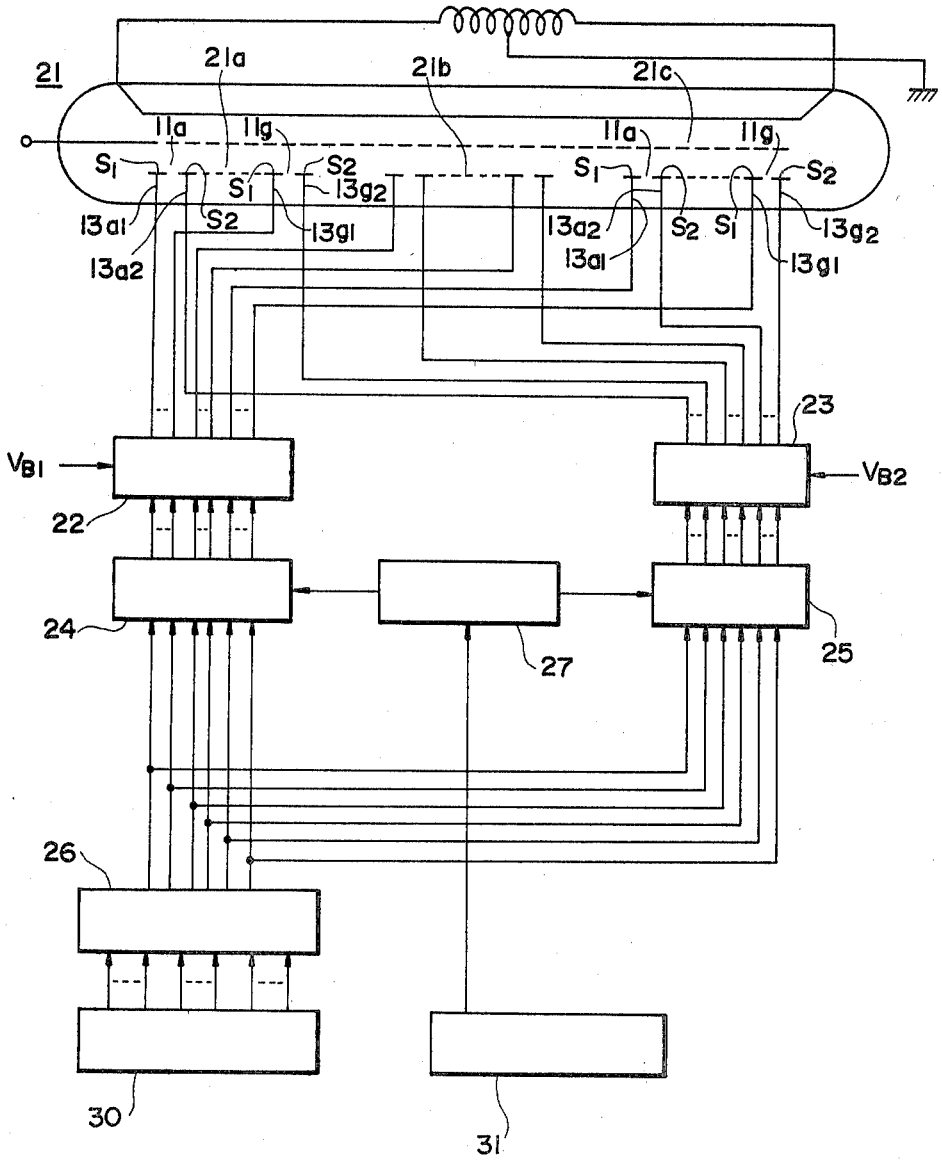
FIG. 8 is a block schematic diagram for driving a fluorescent display apparatus according to an embodiment of the present invention.

In FIG. 8, a fluorescent display apparatus is generally indicated by the reference numeral 21. The fluorescent display apparatus according to this embodiment is provided with display patterns 21*a* to 21*c* of three figures which are formed as explained with reference to FIGS. 3 and 4.

A driving circuit for the fluorescent display apparatus 21 comprises segment driving sections 22 and 23 to which power voltages $VB_1$ and $VB_2$ are applied depending upon excitation voltage for phosphors being used, gates 24 and 25 for controlling transmission of output signals from a decoder 26 in which input signals given, for example, in the form of the BCD signal of three figures are converted into segment signals, and a gate selecting section 27 for effecting opening or closing control of either the gate 24 or both the gates 24 and 25 in response to gate controlling signals. In operation, when one of the gates 24 and 25 is selected in response to the gate controlling signal depending upon magnitude of the input signal, the anode voltage is applied to either the subsegments $S_1$ or $S_2$ of the respective segments 11*a* to 11*g* to cause the sub-segments illuminate in one color. When the other gate is selected by the gate selecting section 27 in response to variation of the input signal, the anode voltage is then applied to the other sub-segments of the respective segments 11*a* to 11*g*, which results in a change of the display color.

Figure 9:
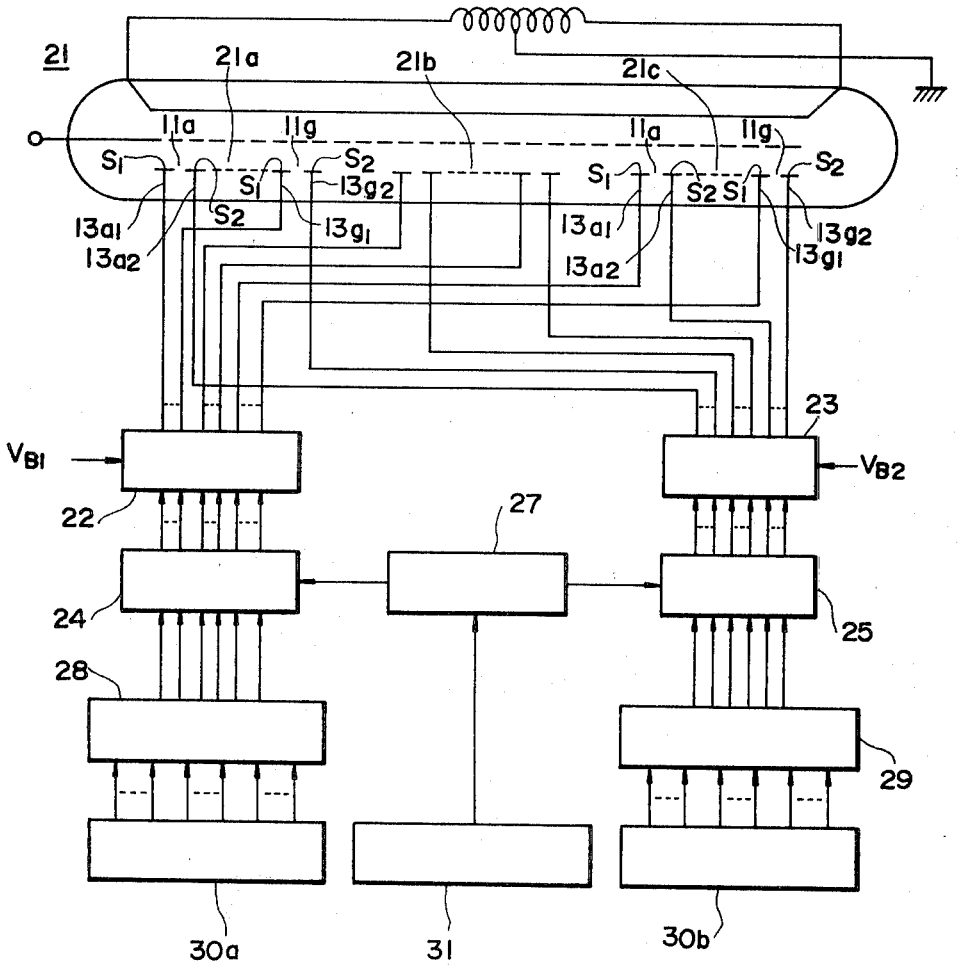
FIG. 9 is a block schematic diagram for driving a fluorescent display apparatus according to another embodiment of the present invention.

A driving circuit shown in FIG. 9 is used for switching two sorts of input signals together with display color. The driving circuit shown in FIG. 9 is equivalent to that shown in FIG. 8 except the input portions . Accordingly, the corresponding sections are identified by the same reference characters and the explanation will be omitted. The driving circuit in this embodiment is provided with two decoders 28 and 29 to which an independent first input signal 30*a* and second input signal 30*b* are applied, respectively, and signals converted by the decoders 28 and 29 are applied to the gates 24 and 25. Thus, in the fluorescent display apparatus using the driving circuit, display can be effected in a color corresponding to each of the input signals selected from the first and second signals by the gate controlling signal, and the display color can be switched simultaneously with a change of the input signal.

The driving circuit shown in FIG. 8 is advantageously applicable to an indicator apparatus, such as, for example, speedometer which is capable of issuing a warning signal by changing a color of speed indicia, for example, from green to red, when the speed exceeds a predetermined limit as well as the indication of the speed. The driving circuit shown in FIG. 9 is advantageously applicable to a measuring instrument indicating two sorts of input signals alternately with different color for rapid and correct observation of the indicated input signals. Furthermore, in a display apparatus using the driving circuit shown in FIG. 9, if input values from various locations are inputed as the first input signal and the address signals of the input values are inputed as the second input signal, the change of the signal is impressively recognized and the visual observation of the signal is remarkably promoted. In this instance, if the address signals are stored in a ROM as a character signal and the contents of the ROM are read and represented corresponding to the first input signal, it is possible to effect the numerical display along with the message display associated therewith and to provide the display apparatus with a highly sophisticated function.

As explained hereinabove, the display apparatus according to the present invention comprises the segmented anodes, each of which is divided into a plurality of the rectangular, square or dotted sub-segments which are in turn classified into at least two groups electrically connected in common and extended to the outer terminals, respectively. Thus, the segments could be observed as a continuous single segment even if the segments are illuminated by selectively energizing the subsegments. Furthermore, there is a little gap at the connecting portion of each segment, which makes it possible to delineate the display pattern of natural type. The fluorescent display apparatus according to the present invention is capable of switching its luminance brightness and displayed variable without distorting the display pattern. Also, it is possible to display several sorts of intricate information in the single display portion by introducing each of the informations into the display portion independently using the simple driving circuit or by switching the contents of the informations to be displayed. Thus, the ratio of occupying the display portion in the overall display apparatus can be reduced and its space factor is significantly improved.

In the fluorescent apparatus in which to include the segments divided into at least two groups and deposited the phosphors of different luminous colors upon the upper surface of each two groups of the respective electrodes, the display color can be switched at the almost same location in each of the segments. According to the present invention, there is a little shift of the illuminating position in the segments even if the display color is switched, and the legible display can be effected. As explained hereinabove, the fluorescent display apparatus of the present invention is advantageously applicable to the speedometer issuing the warning signal when the input signal exceeds a set value by changing the indication color or the measuring instrument indicating the input signals in different colors every time these input signals vary or effecting the address representation of the input signals alternately in the different color from the input signals when a plurality of the input signals are switched in sequential order so as to increase the visual observation of the signals and to avoid the misscanning of the signals. In addition, the fluorescent display apparatus of this invention makes a body of the measuring instrument compact, because several sorts of the input informations are displayed in the same location.

Obviously, many modifications and variations of the present invention are possible in the light of the above teachings. It is therefore to be understood that within the scope of the appended claims, the invention may be practiced otherwise than as specifically described.

What is claimed as new and desired to be secured by Letters Patent of the United States is:

1. In a segment type fluorescent display apparatus for effecting luminous display of numerals or characters by a combination of bar-shaped segmented anodes defining a maximum dimension and having phosphor layers deposited thereon which are excited to illuminate by selectively impinging electrons emitted from a cathode upon said segmented anodes, the improvement comprising:

each anode segment comprising plural groups of subsegments, each group including plural respective of said sub-segments electrically connected in common and extended to a respective external terminal;

the sub-segments of each group of each anode segment being intermixedly arranged and compositely defining a common predetermined anode segment shape and size; and the sub-segments of each group having maximum dimensions substantially smaller than the maximum dimension of the respective compositely shaped and sized anode segment.

2. The segment type fluorescent display apparatus as in claim 1 wherein the sub-segments of the respective groups have deposited thereon phosphors of different luminous colors.

3. The segment type fluorescent display apparatus as in claim 1 wherein the sub-segments in each segment are rectangular shape and arranged in a slanted fashion.

4. The segment type fluorescent display apparatus as in claim 1 wherein the sub-segments are square and the diagonally opposited sub-divided segments have deposited the phosphors of the same luminous colors.

* * * * *